US012692567B2

(12) United States Patent
Kumagai et al.

(10) Patent No.: US 12,692,567 B2
(45) Date of Patent: Jul. 28, 2026

(54) SEAL MEMBER AND METHOD FOR MANUFACTURING SAME

(71) Applicants: HONDA MOTOR CO., LTD., Tokyo (JP); DAIDO STEEL CO., LTD., Nagoya (JP)

(72) Inventors: Yoshiki Kumagai, Nagoya (JP); Yoshinori Sumi, Nagoya (JP); Shigeki Ueta, Nagoya (JP); Hiroki Yamamoto, Tokyo (JP); Isamu Saito, Tokyo (JP)

(73) Assignee: Daido Steel Co., Ltd., Nagoya (JP)

( * ) Notice: Subject to any disclaimer, the term of this patent is extended or adjusted under 35 U.S.C. 154(b) by 787 days.

(21) Appl. No.: 17/917,182

(22) PCT Filed: Apr. 8, 2021

(86) PCT No.: PCT/JP2021/014902
§ 371 (c)(1),
(2) Date: Oct. 5, 2022

(87) PCT Pub. No.: WO2021/206142
PCT Pub. Date: Oct. 14, 2021

(65) Prior Publication Data

US 2023/0160029 A1 May 25, 2023

(30) Foreign Application Priority Data

Apr. 9, 2020 (JP) ..... 2020-070441

(51) Int. Cl.

| | |
|---|---|
| ***C22C 38/50*** | (2006.01) |
| ***C21D 6/00*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/34*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/54*** | (2006.01) |
| ***C22F 1/00*** | (2006.01) |

(52) U.S. Cl.
CPC ..... *C21D 8/0236* (2013.01); *C21D 6/004* (2013.01); *C21D 6/005* (2013.01); *C21D 8/0226* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/34* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22F 1/00* (2013.01)

(58) Field of Classification Search
CPC ..... C22F 1/10
See application file for complete search history.

(56) References Cited

U.S. PATENT DOCUMENTS

| | | | | |
|---|---|---|---|---|
| 5,951,789 | A | 9/1999 | Ueta et al. | |
| 6,099,668 | A | 8/2000 | Ueta et al. | |
| 2004/0184946 | A1* | 9/2004 | Tominaga | C22C 19/056 420/586.1 |
| 2015/0167123 | A1 | 6/2015 | Lasonde et al. | |
| 2018/0354019 | A1 | 12/2018 | Uehara et al. | |

FOREIGN PATENT DOCUMENTS

| | | | |
|---|---|---|---|
| JP | H07-11376 | A | 1/1995 |
| JP | H10-130790 | A | 5/1998 |
| JP | H11-117019 | A | 4/1999 |
| JP | 2004-277860 | A | 10/2004 |

(Continued)

OTHER PUBLICATIONS

Chinese Office Action, dated Jun. 1, 2024, in Chinese Application No. 202180027422.6 and English Translation thereof.
Chinese Office Action dated Jul. 4, 2023, in corresponding Chinese Patent Application No. 202180027422.6, with an English translation thereof.
Chinese Office Action, dated Jan. 13, 2024 in Chinese Application No. 202180027422.6 and English Translation thereof.
International Search Report (ISR) (PCT Form PCT/ISA/210), in PCT/JP2021/014902, dated Jun. 29, 2021.
Written Opinion of the International Searching Authority (WOISA) (PCT Form PCT/ISA/237), in PCT/JP2021/014902, dated Jun. 21, 2021.

*Primary Examiner* — Jophy S. Koshy
(74) *Attorney, Agent, or Firm* — McGinn IP Law Group, PLLC

(57) ABSTRACT

A seal member includes a γ' precipitation-hardening alloy, in which the γ' precipitation-hardening alloy has a component composition of, in mass %: Ni: from 40 to 62%; Cr: from 13 to 20%; Ti: from 1.5 to 2.8%; Al: from 1.0 to 2.0% (provided that Ti/Al: 2.0 or less); Nb: 2.0% or less; Ta: 2.0% or less (provided that Nb+Ta: from 0.2 to 2.0%); B: from 0.001 to 0.010%; W: 3.0% or less; and Mo: 2.0% or less (provided that Mo+(½)W: from 1.0 to 2.5%), and optionally, C: 0.08% or less; Si: 1.0% or less; Mn: 1.0% or less; P: 0.02% or less; and S: 0.01% or less, with the balance being Fe and inevitable impurities, and in which the seal member has a hardness of 250 Hv or more, and includes a cold-rolled microstructure obtained by a cold rolling.

7 Claims, 6 Drawing Sheets

(56) References Cited

FOREIGN PATENT DOCUMENTS

| | | | |
|---|---|---|---|
| JP | 2005-002451 | A | 1/2005 |
| JP | 2008-304059 | A | 12/2008 |
| JP | 2014-194262 | A | 10/2014 |
| JP | 2015-529743 | A | 10/2015 |
| WO | WO 2017/104755 | A1 | 6/2017 |
| WO | WO 2019/189576 | A1 | 10/2019 |

* cited by examiner

FIG. 5

| | Chemical component (mass%) | | | | | | | | | | | | | | | |
|---|---|---|---|---|---|---|---|---|---|---|---|---|---|---|---|---|
| | C | Si | Mn | P | S | Ni | Cr | Nb | Ta | Ti | Al | W | Mo | B | Fe | Cu |
| Example 1 | 0.05 | 0.15 | 0.2 | 0.010 | 0.0005 | 50 | 15 | 1.30 | - | 2.58 | 1.46 | 1.45 | 0.9 | 0.004 | Bal. | - |
| Example 2 | 0.03 | 0.19 | 0.4 | 0.002 | 0.0005 | 45 | 14 | 1.50 | 0.27 | 2.54 | 1.28 | 2.4 | 0.4 | 0.002 | Bal. | 0.26 |
| Example 3 | 0.03 | 0.21 | 0.3 | 0.001 | - | 60 | 15 | 0.10 | 0.90 | 2.38 | 1.50 | 1.0 | 1.6 | 0.002 | Bal. | - |
| Example 4 | 0.02 | 0.52 | 0.2 | 0.001 | - | 60 | 18 | 0.70 | 0.10 | 2.00 | 1.80 | 1.5 | 1.2 | 0.002 | Bal. | - |
| Example 5 | 0.05 | 0.15 | 0.2 | 0.003 | 0.0005 | 49 | 16 | 1.20 | 0.30 | 2.35 | 1.20 | 1.5 | 1.0 | 0.003 | Bal. | 2.50 |
| Example 6 | 0.05 | 0.15 | 0.2 | 0.003 | 0.0005 | 49 | 16 | 1.20 | 0.30 | 2.35 | 1.20 | 1.5 | 1.0 | 0.003 | Bal. | 2.50 |
| Comparative Example 1 | 0.05 | 0.15 | 0.2 | 0.006 | 0.0005 | 50 | 15 | 1.00 | 0.10 | 2.28 | 1.09 | 1.5 | 1.0 | 0.003 | Bal. | - |
| Comparative Example 2 | 0.02 | 0.10 | 0.2 | 0.001 | 0.0005 | 54 | 18 | 3.00 | 2.20 | 0.90 | 0.50 | - | 3.0 | 0.003 | Bal. | - |
| Comparative Example 3 | 0.09 | 0.16 | 0.2 | 0.001 | 0.0010 | 41 | 18 | 0.80 | 0.27 | 2.38 | 0.75 | 0.5 | 2.0 | 0.004 | Bal. | - |

*FIG. 6*

| | Nb+Ta | Ti/Al | Mo+1/2W |
|---|---|---|---|
| Example 1 | 1.3 | 1.77 | 1.63 |
| Example 2 | 1.77 | 1.98 | 1.60 |
| Example 3 | 1.0 | 1.59 | 2.10 |
| Example 4 | 0.8 | 1.11 | 1.95 |
| Example 5 | 1.5 | 1.96 | 1.75 |
| Example 6 | 1.5 | 1.96 | 1.75 |
| Comparative Example 1 | 1.1 | 2.09 | 1.75 |
| Comparative Example 2 | 5.2 | 1.80 | 3.00 |
| Comparative Example 3 | 1.07 | 3.17 | 2.25 |

FIG. 7

| | Cold-rolling ratio (%) | Inhomogeneous strain (%) | Normal temperature hardness (Hv) | Area ratio of the unrecrystallized grain (%) | High-temperature hardness (Hv) | Judgement |
|---|---|---|---|---|---|---|
| Example 1 | 30 | 0.22 | 380 | 55 | 220 | A |
| Example 2 | 35 | 0.25 | 400 | 40 | 230 | A |
| Example 3 | 12 | 0.10 | 260 | 80 | 220 | A |
| Example 4 | 35 | 0.24 | 350 | 50 | 220 | A |
| Example 5 | 30 | 0.20 | 345 | 50 | 200 | A |
| Example 6 | 50 | 0.35 | 400 | 20 | 170 | B |
| Comparative Example 1 | 30 | 0.18 | 330 | 5 | 120 | C |
| Comparative Example 2 | 38 | 0.28 | 420 | 0 | 110 | C |
| Comparative Example 3 | 30 | 0.19 | 330 | 0 | 130 | C |

SEAL MEMBER AND METHOD FOR MANUFACTURING SAME

TECHNICAL FIELD

The present invention relates to a seal member including a γ' precipitation-hardening cold-rolled band material and a manufacturing method thereof, and more particularly to a seal member capable of maintaining its functions even in a usage environment at about 900° C. and a manufacturing method thereof.

BACKGROUND ART

For sealing a joint between pipes abutted against each other and preventing a liquid or gas flowing inside the pipes from leaking through the joint, a metallic seal member is inserted into the joint. For example, turbo-charger pipes incorporated in a reciprocating engine are used under a high temperature of approximately from 700 to 800° C. and therefore, a precipitation-hardening Ni-base or Ni—Fe-based heat-resistant alloy having excellent high-temperature strength, such as Inconel 718 (product name) or Nimonic 263 (product name), is used for the seal member.

For example, Patent Literature 1 discloses an Fe—Ni—Cr-based alloy for exhaust valves of an automobile engine, etc., which can maintain high strength even when exposed to 800° C. for a long time while decreasing the Ni amount. This alloy has a component composition prepared by adding, in mass %, Ni: from 30 to 62%, Cr: from 13 to 20%, etc. to Fe and is subjected to a solution treatment at 1,050° C. and then to an aging treatment at 750° C. Although the γ' phase that is a precipitation phase providing high-temperature strength becomes unstable due to decrease in the Ni amount, it is stated that this can be avoided by adjusting the Ti amount.

Also, Patent Literature 2 discloses a method for manufacturing heat-resistant parts, in which an alloy having a component composition prepared by adding, in mass %, Ni: from 30 to 45% and Cr: from 10 to 25% as well as Ti, Al, etc. to Fe and adjusting the atomic ratio of Ti/Al is subjected to cold worked or hot worked, then processed into parts, and subjected to an aging treatment while the processing strain remains. It is stated that in such heat-resistant parts, even when exposed to 800° C. or more for a long time, precipitation of the phase that is an embrittlement phase can be suppressed by adjusting the atomic ratio of Ti/Al and the mechanical strength does not decrease.

With the above-described heat-resistant alloy, a sealing property enough as a seal member is expected to be obtained. Furthermore, a seal member for automobile engines, such as exhaust gasket, is repeatedly heated from room temperature to a high temperature at the time of use and cooled and therefore, is required to have excellent settling resistance, like a "spring".

For example, cited Literature 3 discloses an Fe—Ni—Cr-based alloy for heat-resistant springs, having a component composition prepared by adding, in mass %, Ni: from 20 to 45%, Cr: from 10 to 25%, etc. to Fe, and being usable at approximately from 500 to 600° C. In the manufacturing process of a spring, this alloy is subjected to cold rolling or cold working such as cold drawing and then to an aging treatment. Here, in order to enhance the settling resistance, it is stated that it is necessary to increase the amounts of γ' phase-forming elements to optimize the atomic % ratio of Ti and Al, that B is added, and that solid-solution strengthening elements, such as Mo and W, are added.

CITATION LIST

Patent Literature

Patent Literature 1: JP-A-2004-277860
Patent Literature 2: JP-A-H11-117019
Patent Literature 3: JP-A-2005-002451

SUMMARY OF INVENTION

Technical Problem

As for the seal member, in recent years, along with the recent performance enhancement of a turbo-charger, use at about 900° C. that is higher than the conventional temperature is required. In this connection, in the above-described general-purpose Ni-base alloys, generally, γ" phase or γ' phase, which are a precipitation phase providing high-temperature strength at 800° C. or more, changes to δ phase not contributing to high-temperature strength, and the seal property is likely to be reduced. In addition, γ' phase may sometimes disappear at about 900° C., and this also causes a reduction in the seal property. On the other hand, although it may be considered to add Co that is an element enhancing the high-temperature strength, this deteriorates the workability in cold rolling as a seal member, and a cost disadvantage occurs as well.

The present invention has been made in consideration of such circumstances, and an object of the present invention is to provide a seal member including a cold-rolled band material capable of maintaining its functions even in a usage environment at about 900° C. while avoiding excessive addition of Co.

Solution to Problem

A seal member including a γ' precipitation-hardening alloy, in which the γ' precipitation-hardening alloy has a component composition consisting of, in mass %:

Ni: from 40 to 62%;
Cr: from 13 to 20%;
Ti: from 1.5 to 2.8%;
Al: from 1.0 to 2.0% (provided that Ti/Al: 2.0 or less);
Nb: 2.0% or less;
Ta: 2.0% or less (provided that Nb+Ta: from 0.2 to 2.0%);
B: from 0.001 to 0.010%;
W: 3.0% or less; and
Mo: 2.0% or less (provided that Mo+(½)W: from 1.0 to 2.5%), and optionally, C: 0.08% or less;
Si: 1.0% or less;
Mn: 1.0% or less;
P: 0.02% or less; and
S: 0.01% or less, with the balance being Fe and inevitable impurities, and in which the seal member has a hardness of 250 Hv or more, and includes a cold-rolled microstructure obtained by a cold rolling.

According to such feature, disappearance of fine precipitates including a γ' phase is suppressed even over long-term use at a high temperature, and the functions as a seal member can be maintained even in a usage environment at about 900° C.

The above-described invention may include a metal microstructure where fine precipitates including a γ' phase are dispersed in a crystal grain. According to such a feature, strengthening by the γ' phase is previously obtained, and the functions as a seal member can be maintained even in a usage environment at about 900° C.

In the above-described invention, 5% or less of the Ni may be replaced by Co. According to such a feature, the creep strength is enhanced, and the functions as a seal member can be maintained even in a usage environment at about 900° C.

In the above-described invention, the component composition may further include Cu: from 0.1 to 3.0%. According to such a feature, the cold workability and oxidation resistance are enhanced, and the functions as a seal member can be maintained even in a usage environment at about 900° C.

In the above-described invention, the cold-rolled microstructure may include 0.05% or more of an inhomogeneous strain. According to such a feature, the functions as a seal member can be maintained even in a usage environment at about 900° C.

In the above-described invention, the cold-rolled microstructure may maintain an area ratio of an unrecrystallized grain including the γ' phase in a crystal grain at 30% or more in an observation cross-section after heating at 900° C. for 400 hours. According to such a feature, disappearance of fine precipitates including the γ' phase is more suppressed even in usage over 400 hours at 900° C., and the functions as a seal member can be maintained.

A method for manufacturing a seal member including a γ' precipitation-hardening alloy, the method including:

a hot-rolling step of processing an alloy having a component composition consisting of, in mass %;

Ni: from 40 to 62%;

Cr: from 13 to 20%;

Ti: from 1.5 to 2.8%;

Al: from 1.0 to 2.0% (provided that Ti/Al: 2.0 or less);

Nb: 2.0% or less;

Ta: 2.0% or less (provided that Nb+Ta: from 0.2 to 2.0%);

B: from 0.001 to 0.010%;

W: 3.0% or less; and

Mo: 2.0% or less (provided that Mo+(½)W: from 1.0 to 2.5%), and optionally,

C: 0.08% or less;

Si: 1.0% or less;

Mn: 1.0% or less;

P: 0.02% or less; and

S: 0.01% or less, with the balance being Fe and inevitable impurities, and a cold-rolling step of providing a cold-rolling strain so as to have a hardness of 250 Hv or more.

According to such a feature, disappearance of fine precipitates including a γ' phase is suppressed even over long-term use at a high temperature, and a seal member capable of maintaining its functions even in a usage environment at about 900° C. can be obtained.

In the above-described invention, the hot-rolling step or cold-rolling step may be a step of providing a metal microstructure where fine precipitates including a γ' phase are dispersed in a crystal grain. According to such a feature, strengthening by the γ' phase is previously obtained, and a seal member capable of maintaining the functions as a seal member even in a usage environment at about 900° C. can be obtained.

In the above-described invention, 5% or less of the Ni may be replaced by Co. According to such a feature, the creep strength is enhanced, and a seal member capable of maintaining the functions as a seal member even in a usage environment at about 900° C. can be maintained.

In the above-described invention, the component composition may further include Cu: from 0.1 to 3.0%. According to such a feature, the cold workability and oxidation resistance are enhanced, and a seal member capable of maintaining the functions as a seal member even in a usage environment at about 900° C. can be maintained.

In the above-described invention, the cold-rolling step may be a step of providing a cold-rolled microstructure including 0.05% or more of an inhomogeneous strain. According to such a feature, a seal member capable of maintaining the functions as a seal member even in a usage environment at about 900° C. can be obtained.

In the above-described invention, the cold-rolling step may be a step of providing a cold-rolled microstructure maintaining an area ratio of an unrecrystallized grain including the γ' phase in a crystal grain at 30% or more in an observation cross-section after heating at 900° C. for 400 hours. According to such a feature, the disappearance of fine precipitates including the γ' phase even in usage over 400 hours at 900° C. and a seal member capable of maintaining the functions as a seal member can be obtained.

BRIEF DESCRIPTION OF DRAWINGS

FIG. 5 is a list of the component compositions with respect to Examples and Comparative Examples in a manufacturing test.

FIG. 6 is a list of values of conditional expressions regarding the component compositions of Examples and Comparative Examples.

FIG. 7 is a list of cold-rolling ratios and test results of Examples and Comparative Examples.

DESCRIPTION OF EMBODIMENTS

Figure 1:
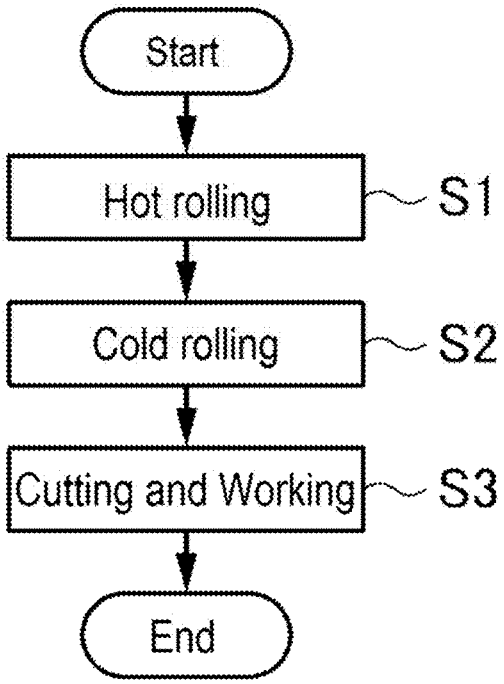
FIG. 1 is a flow diagram illustrating a method for manufacturing a seal member in one embodiment according to the present invention.
Figure 2:
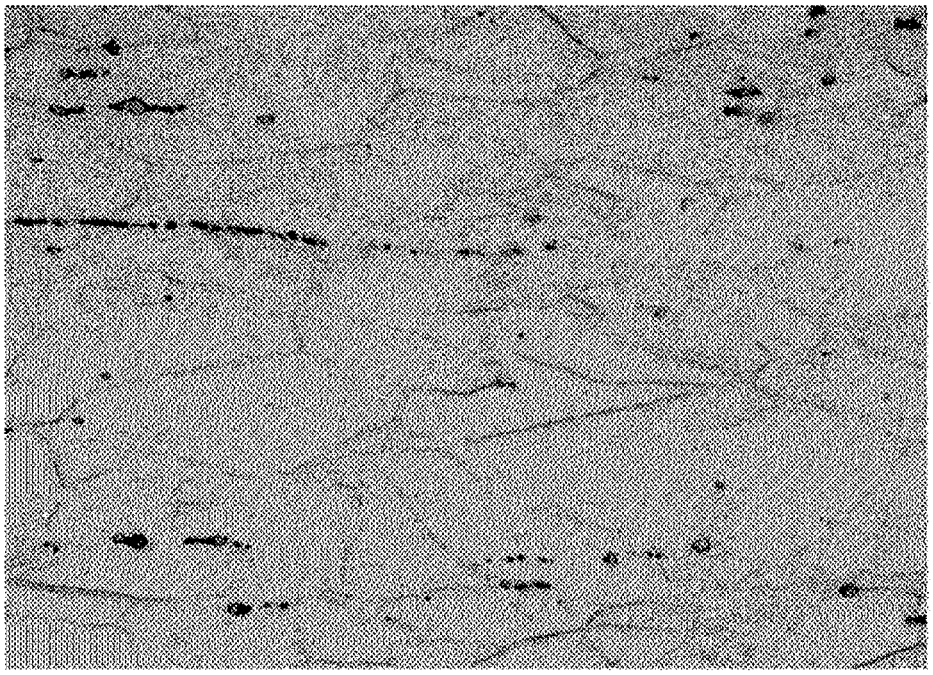
FIG. 2 is a cross-sectional microstructure photograph in which the vertical direction on a plane of paper showing a cold-rolled band material for a seal member indicates the compression direction.
Figure 3:
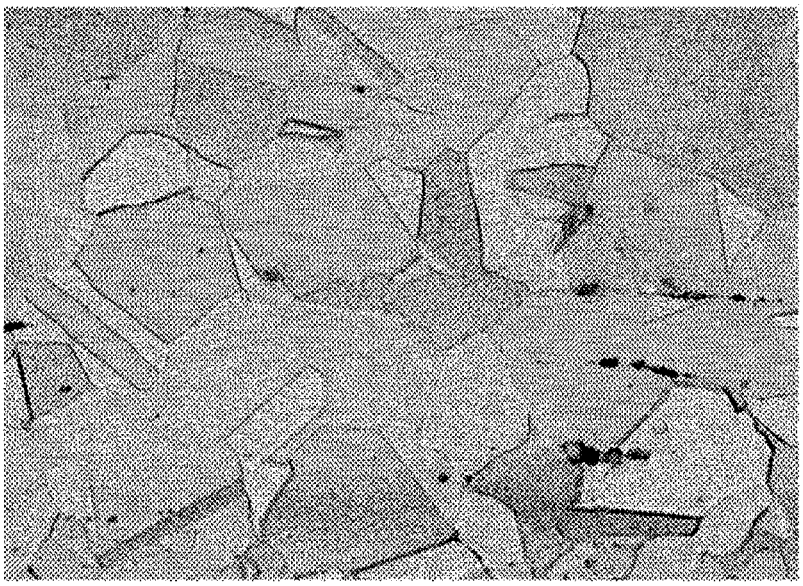
FIG. 3 is a cross-sectional microstructure photograph of when an annealing treatment and an aging treatment are performed after cold rolling.

The seal member as one embodiment according to the present invention and the manufacturing method thereof are described by referring to FIGS. 1 to 3.

The seal member according to the present embodiment is obtained using an Fe—Ni—Cr-based alloy having a component composition that consists of, in mass %, Ni: from 40 to 62%, Cr: from 13 to 20%, Ti: from 1.5 to 2.8%, Al: from 1.0 to 2.0% (provided that Ti/Al: 2.0 or less), Nb: 2.0% or less, Ta: 2.0% or less (provided that Nb+Ta: from 0.2 to 2.0%), B: from 0.001 to 0.010%, W: 3.0% or less, and Mo: 2.0% or less (provided that Mo+(½)W: from 1.0 to 2.5%) and optionally, C: 0.08% or less, Si: 1.0% or less, Mn: 1.0% or less, P: 0.02% or less, and S: 0.01% or less, with the balance being substantially Fe.

As illustrated in FIG. 1, the Fe—Ni—Cr-based alloy is processed by hot forging, etc. to produce a slab or billet and then formed into a desired shape by hot rolling (hot rolling: S1). Furthermore, a cold-rolled band material for the seal member, which serves as a material of the seal member, is formed by cold rolling and thereby caused to have a hardness of 250 Hv or more (cold rolling: S2). By obtaining such a hardness, the bead shape can be maintained when the cold-rolled band material for the seal member is fastened as a seal member, and the sealing property can be ensured. Incidentally, it is also preferable to further make the hardness to be 420 Hv or less, and in this case, cracking at the time of fastening the obtained seal member is prevented.

In the cold rolling (S2), it is preferable that rolling be performed a plurality of times and an annealing treatment be performed between respective rollings. This makes it possible to obtain a γ' precipitation-hardening cold-rolled band material for the seal member. That is, the cold-rolled band material for the seal member is obtained by employing cold rolling as the final step and in obtaining a seal member, heat treatment after cold rolling is not required. Incidentally, the thickness of the cold-rolled band material for the seal member is in the range of from 0.05 mm to 0.5 mm, preferably in the range of from 0.1 mm to 0.3 mm.

Here, as illustrated in FIG. 2, the thus-obtained cold-rolled band material for the seal member has the above-described hardness of 250 Hv or more and has a cold-rolled microstructure resulting from cold rolling. In particular, crystal grains are arranged so that the longitudinal direction of the crystal grain is oriented in the rolling direction (horizontal direction on a plane of paper). It is considered that such a rolled microstructure can also contribute to maintaining mechanical strength at a high temperature.

The cold-rolled band material for the seal member may be manufactured to have a cold-rolled microstructure that is obtained by letting fine precipitates including the γ' phase be dispersed in a crystal grain and cold rolling, but fine precipitates of the γ' phase may not be dispersed in a crystal grain.

In the former case, for example, the temperature at heating in hot rolling (Si) or at annealing treatment in cold rolling (S2) may be set higher than the solvus temperature of the γ' phase. The cooling rate after such heating is preferably set to be from 1 to 50° C./s to cool to 800° C., and under such cooling conditions, the cold-rolled microstructure where fine precipitates including the γ' phase are dispersed in the crystal grain is efficiently obtained. Incidentally, the cooling conditions for 800° C. or less may be appropriately set. In addition, the precipitation of the γ' phase is not limited to either one of hot rolling (Si) and cold rolling (S2), and it is also possible to precipitate the γ' phase in two steps.

In the latter case, use in a usage environment at 800° C. or more makes it possible to directly obtain the metal microstructure where fine precipitates including the γ' phase are dispersed in the crystal grain, and thereby maintaining the functions required as a seal member even in a usage environment, for example, at about 900° C.

Incidentally, as illustrated in FIG. 3, it is seen that in the case where an annealing treatment and an aging treatment are performed after cold rolling, the crystal grains have no orientation and this leads to disappearance of the cold-rolled microstructure. That is, after the cold rolling, such a heat treatment is unnecessary.

Next, the cold-rolled band material for the seal member is cut by a known method and worked into a shape of the seal member (cutting and working: S3). As described above, the seal member is not heat-treated before and after cutting and working (S3) and is used as a seal member while leaving intact the cold-rolled microstructure obtained by cold rolling (S2).

According to this seal member, disappearance of fine precipitates including the (phase can be suppressed even when used as a seal member over a long time at a high temperature, and the functions as a seal member can be maintained even in a usage environment, for example, at about 900° C.

Figure 4:
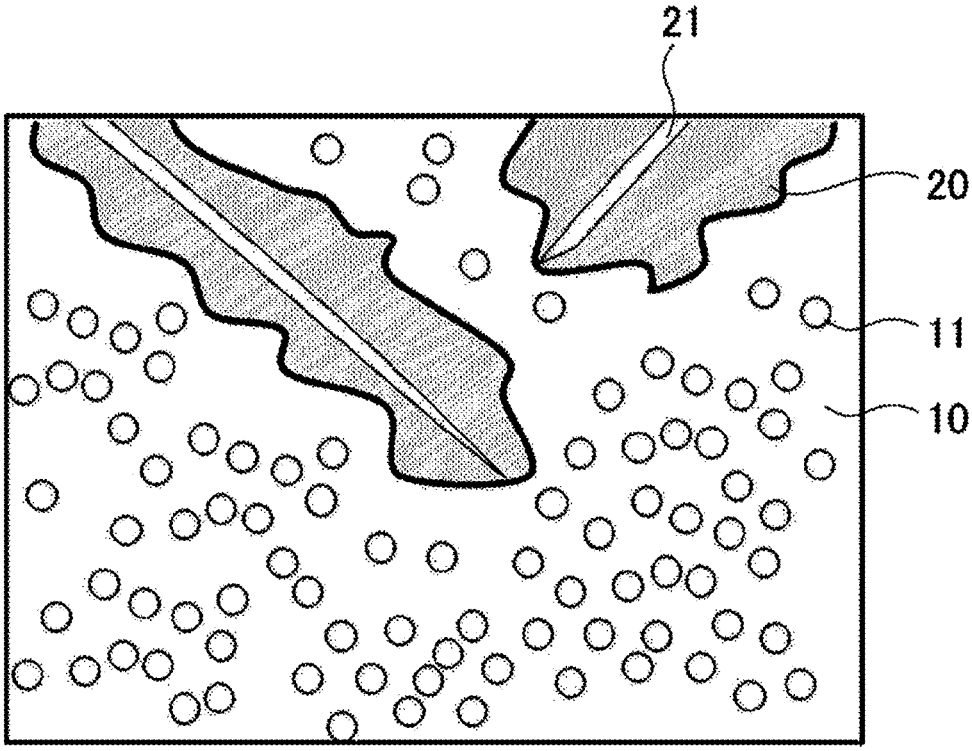
FIG. 4 is a schematic diagram illustrating a cross-sectional microstructure of an alloy used at a high temperature for a long time.

Meanwhile, as illustrated in FIG. 4, in a γ' precipitation-hardening alloy where fine precipitates (hereinafter, referred to as γ' grain 11) including the γ' phase are dispersed, the (grain 11 during use at a high temperature is sometimes transformed to phase or δ phase 21 as recrystallization proceeds, resulting in production of a recrystallized grain 20 including phase or δ phase 21. The γ' grain 11 is necessary for maintaining high mechanical strength particularly at a high temperature, and its disappearance causes a decrease in the mechanical strength. Therefore, remaining of many unrecrystallized grains 10 that are crystal grains retaining γ' grains without being recrystallized even in a long-term use at a high temperature is preferable for the seal member. This can be confirmed by a heating test and, for example, after performing a heating test at 900° C. for 400 hours, the area ratio of the unrecrystallized grain 10 including the γ' phase in the crystal grain is measured in an observation cross-section. After such a heating test, the area ratio of the unrecrystallized grain 10 is preferably maintained at 30% or more.

The cold-rolled microstructure of the cold-rolled band material for the seal member obtained by cold rolling preferably includes 0.05% or more of an inhomogeneous strain, more preferably from 0.05 to 0.33% of an inhomogeneous strain. This makes it possible to surely obtain mechanical strength required as a seal member, such as the above-described hardness. Here, the inhomogeneous strain was measured as follows by the Williamson-Hall method. Specifically, a test specimen of 10×10 mm is sampled from the cold-rolled band material for the seal member and then mechanical polishing from the surface is performed, followed by removing the strained layer due to mechanical polishing with electrolytic polishing, thereby reducing the sheet thickness to ½ of the original sheet thickness. In this test specimen, XRD measurement using an X-ray diffractometer equipped with a Co vacuum tube was performed, and half-widths of diffraction peaks of (111), (200), (220), (311) and (222) planes were determined using a commercially available XRD analysis software, "JADE 9.6". After correcting the obtained values by using half-widths of a non-strain Si sample, Williamson-Hall plots ware created, and the inhomogeneous strain E was determined from its slope.

Also, the rolling ratio (cold-rolling ratio) by cold rolling is preferably, in total, 10% or more, more preferably in the range of from 10 to 40%. This rolling ratio makes it easy to obtain the above-described inhomogeneous strain.

Incidentally, the component composition above may be a component composition in which 5% or less of the Ni is replaced by Co. Addition of Co may enable enhancing the creep strength. Also, the component composition above may be a component composition further including in the range from 0.1 to 3.0 mass % of Cu. Addition of Cu may make it possible to enhance the cold workability and oxidation resistance.

[Manufacturing Test]

Then, the results from actually manufacturing a cold-rolled band material and examining inhomogeneous strain for the rolling ratio, normal temperature hardness, area ratio of an unrecrystallized grain, and high-temperature hardness are described by referring to FIGS. 5 to 9. Incidentally, the cold-rolled band material for the seal member is worked into a seal member without being heat-treated as described above and therefore, can provide evaluations of a seal member.

First, cold-rolled band materials were obtained in the same manner as above by using alloys having respective component compositions shown in Examples 1 to 6 and Comparative Examples 1 to 3 of FIGS. 5 and 6. Here, FIG. 6 shows calculation results of conditional expressions using values when the content of each element in the component compositions shown in FIG. 5 is represented in mass %.

As shown in FIG. 7, with respect to each of the obtained cold-rolled band materials, the inhomogeneous strain, normal temperature hardness, area ratio of the unrecrystallized grain, and high-temperature hardness at 900° C. were measured and recorded. As the seal member, it is required to have the normal temperature hardness of 250 Hv or more. Also, it is required to cause the unrecrystallized grain to remain after a heating test of 900° C.×400 hours. Here, those where the area ratio of the unrecrystallized grain after the heating test is 20% or more while the normal temperature hardness is 250 Hv or more were judged as "passed", and "B" was recorded; those where the area ratio is 30% or more while the normal temperature hardness is 250 Hv or more were judged as "good", and "A" was recorded; and others were judged as "failed", and "C" was recorded.

In all of Examples 1 to 6, the obtained cold-rolled band material had a normal temperature hardness of 250 Hv or more and the area ratio of the unrecrystallized grain after the heating test of 20% or more and was judged as "good" or "passed". Furthermore, in all Examples, the normal temperature hardness was in a preferable range of 420 Hv or less, and the inhomogeneous strain was also in a preferable range of 0.05% or more. The high-temperature hardness was stabilized at a relatively high value of from 170 to 230 Hv.

Figure 8:
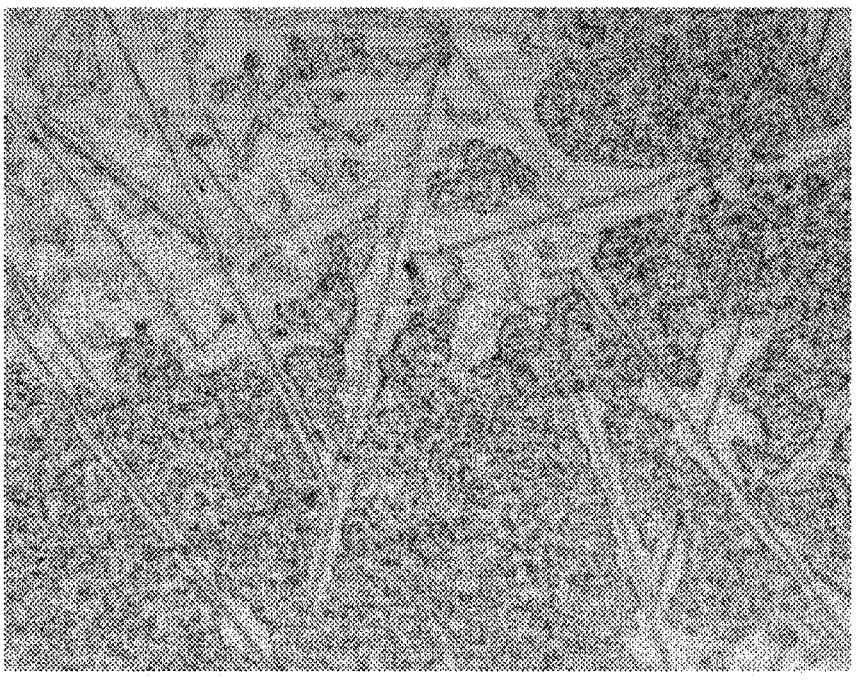
FIG. 8 is a cross-sectional microstructure photograph after the heating test of Example 1.

Referring to FIG. 8 in conjunction, it was found that in the cross-sectional microstructure after the heating test of Example 1, the unrecrystallized grains allowing the γ' phase grains to remain are arranged over a wide range in the cross-section.

Incidentally, in Example 6, the area ratio of the unrecrystallized grain was just 20% to be judged as "passed" and was slightly far from Examples 1 to 5 showing a value exceeding 30% to be judged as "good". Also, the inhomogeneous strain was, in Examples 1 to 5, from 0.05 to 0.33% that is a preferable range, whereas in Example 6, it was 0.35% that is greater than that. More specifically, in Examples 1 to 5, the area ratio of the unrecrystallized grain and the inhomogeneous strain are in more preferable ranges than those in Example 6, and the cause thereof is considered to be attributable to the rolling ratio of cold rolling. It was considered that in Example 6, the cold-rolling ratio was set to 50% that is larger than in other Examples and this was the cause of increasing the inhomogeneous strain and in the heating test, promoting a change of γ' phase to η phase or recrystallization. That is, as for the cold-rolling ratio, the preferable range was supposed to be from 10 to 40% including Examples 1 to 5.

On the other hand, in Comparative Example 1, the area ratio of the unrecrystallized grain after the heating test was set to be as small as 5%, and in turn, the high-temperature hardness was 120 Hv and was significantly low compared with Examples. As a result, a judgment of "failed" was made. It was considered that since the Ti/Al value exceeded 2.0, the γ' phase was made unstable and unrecrystallized grains could not be sufficiently retained after the heating test.

Figure 9:
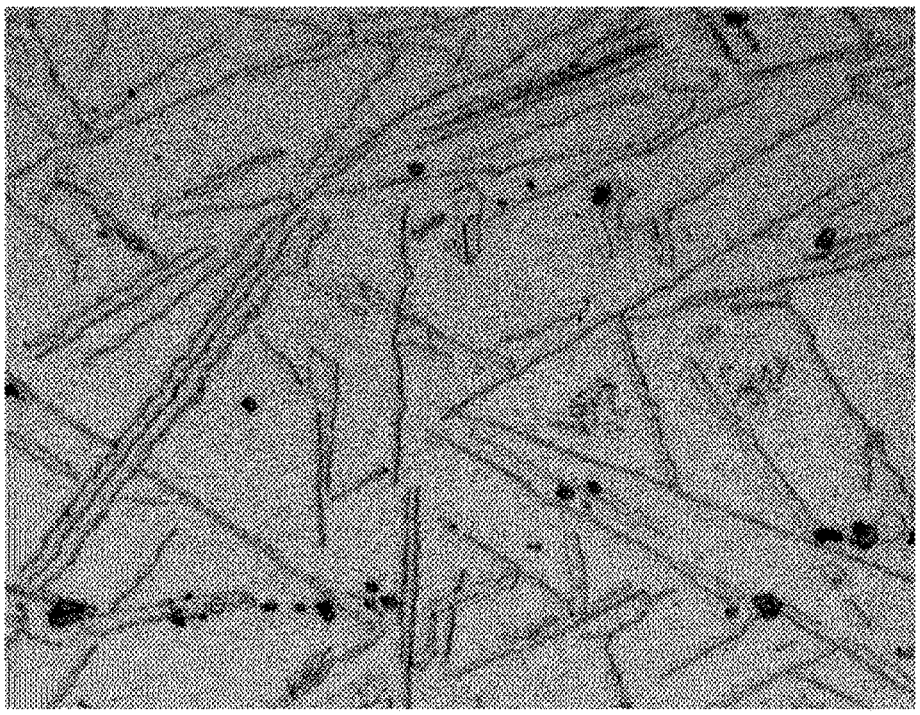
FIG. 9 is a cross-sectional microstructure photograph after the heating test of Comparative Example 1.

Referring to FIG. 9 in conjunction, it was found that in the cross-sectional microstructure after the heating test of Comparative Example 1, only a small number of unrecrystallized grains retaining γ' phase grains are allowed to remain and recrystallized grains including phase are arranged over a wide range.

In Comparative Example 2, unrecrystallized grains after the heating test were substantially not allowed to remain, resulting in an area ratio of 0% and the high-temperature hardness of 110 Hv, which were significantly low compared with Examples. As a result, a judgment of "failed" was made. It was considered that the normal temperature hardness was obtained by increasing the amount of Mo as a result of decreasing the contents of Ti and Al that are γ' forming elements, but since production of γ' phase grains was reduced, unrecrystallized grains after the heating test could not be retained.

In Comparative Example 3, unrecrystallized grains after the heating test were substantially not allowed to remain, resulting in an area ratio of 0% and the high-temperature hardness of 130 Hv, which were significantly low compared with Examples. As a result, a judgment of "failed" was made. It was considered that the content of Al acting as a γ' forming element was small, the value of Ti/Al exceeded 2.0, making γ' phase unstable and since recrystallization was induced by containing a large amount of C, unrecrystallized grains after the heating test could not be retained.

As described above, a judgment of "failed" was made in Comparative Examples 1 to 3, whereas the judgment was "good" in Examples 1 to 5 and "passed" in Example 6, in which the normal temperature hardness was 250 Hv or more and a relatively large number of unrecrystallized grains were caused to remain after the heating test. More specifically, it was understood that a cold-rolled band material for a seal member capable of maintaining mechanical strength at a high temperature can be obtained and in turn, a seal member capable of maintaining mechanical strength at a high temperature can likewise be obtained Incidentally, the composition range of an alloy capable of providing mechanical properties almost equivalent to those of the cold-rolled band material for the seal member and the seal member, which can be judged as "good" or "passed", including Examples above, is determined as follows.

Ni is an element necessary for transforming the matrix to austenite so as to enhance the heat resistance and corrosion resistance, forming γ' phase that is a precipitation-strengthening phase, and obtaining phase stability and mechanical strength to thereby ensure hot workability. On the other hand, in the case where this element is contained excessively, the cost increases. In consideration of these, Ni is, in mass %, in the range of from 40 to 62%, preferably in the range of from 40 to 54%, more preferably in the range of from 45 to 54%.

Cr is an element necessary for ensuring the heat resistance. On the other hand, in the case where this element is contained excessively, σ phase is precipitated to reduce the toughness, and the mechanical strength at a high temperature is lowered. In consideration of these, Cr is, in mass %, in the range of from 13 to 20%, preferably in the range of from 13 to 18%.

Ti is an element necessary for forming the γ' phase effective in enhancing the mechanical strength at a high temperature by combining with Ni as well as Al, Nb and Ta, and maintaining the solid solution temperature of γ' phase high. On the other hand, in the case where this element is contained excessively, the workability is reduced, and η phase ($Ni_3$(Ti, Nb)) is likely to be precipitated, causing a reduction in the mechanical strength at a high temperature. In consideration of these, Ti is, in mass %, in the range of from 1.5 to 2.8%.

Al is an element necessary for forming γ' phase by combining with Ni, and thereby ensuring the mechanical strength at a high temperature. On the other hand, in the case where this element is contained excessively, the hot workability is reduced. In consideration of these, Al is, in mass %, in the range of from 1.0 to 2.0%.

Here, Ti/Al dominates the phase stability of the γ' phase formed as fine precipitates so as to provide precipitation hardening. Phase stabilization is obtained when the ratio is 2.0 or less, but in the case where the ratio exceeds 2.0, precipitation of phase is induced. Accordingly, Ti/Al is set to 2.0 or less.

Nb is a γ' phase-forming element and is effective in promoting hardening by the γ' phase. On the other hand, in the case where this element is contained excessively, precipitation of η phase ($Ni_3$(Ti, Nb)) is facilitated, and the mechanical strength at a high temperature is reduced. In addition, Ta is also a γ' phase-forming element and is effective in promoting hardening by the γ' phase. On the other hand, in the case where this element is contained excessively, precipitation of η phase ($Ni_3$(Ti, Ta)) is facilitated, and the mechanical strength at a high temperature is reduced as well. In consideration of these, in mass %, Nb is in the range of 2.0% or less, and Ta is in the range of 2.0% or less. However, Nb+Ta is in the range of from 0.2 to 2.0%.

B contributes to enhance the hot workability and is an element effective in suppressing formation of η phase, thereby preventing reduction in the mechanical strength and the toughness at a high temperature, and furthermore effective in increasing the high-temperature creep strength. On the other hand, in the case where this element is contained excessively, the melting point of the alloy drops and in turn, the hot workability deteriorates. In consideration of these, B is, in mass %, in the range of from 0.001 to 0.010%.

W and Mo are elements necessary for enhancing the mechanical strength at a high temperature by forming a solid solution to strengthen the matrix. On the other hand, in the case where these elements are contained excessively, an increase in the cost and a decrease in the workability are caused. In consideration of these, in mass %, W is 3.0% or less, Mo is in the range of 2.0% or less, and furthermore, Mo+(½)W is in the range of from 1.0 to 2.5%.

C is an element effective in enhancing the mechanical strength at a high temperature by combining with Cr, Ti, Nb or Ta to form a carbide and may be optionally added. On the other hand, in the case where this element is contained excessively, an excess of carbide is produced to impair hot workability, cold workability, toughness and ductility and in addition, recrystallization is induced with the carbide as a starting point, causing a reduction in the mechanical strength at a high temperature. In consideration of these, C is, in mass %, in the range of 0.08% or less.

Si is an element acting mainly as a deoxidizer during melting and refining and may be optionally added. On the other hand, in the case where this element is contained excessively, the toughness is reduced and the workability is impaired. In consideration of these, Si is, in mass %, in the range of 1.0% or less.

Mn is an element acting as an oxidizer similarly to Si and may be optionally added. On the other hand, in the case where this element is contained excessively, the workability or oxidation resistance at a high temperature is impaired. In consideration of these, Mn is, in mass %, in the range of 1.0% or less.

P and S are inevitably contained impurities and deteriorate the hot workability. Therefore, in mass %, P is 0.02% or less, and S is in the range of 0.01% or less.

Co is effective in enhancing the creep strength at a high temperature. On the other hand, in the case where this element is contained excessively, not only the cost increases but also the phase stability of the γ' phase is reduced. In consideration of these, Co may be contained by replacing part of Ni in the range of, in mass %, 5% or less.

Cu enhances the cold workability, is effective in increasing the oxidation resistance, and may be optionally added. On the other hand, in the case where this element is contained excessively, the hot workability is reduced. In consideration of these, Cu may be optionally added in the range of, in mass %, from 0.1 to 3.0%.

While representative embodiments of the present invention have been described hereinabove, the present invention is not necessarily limited to these, and one skilled in the art may be able to find various alternative embodiments and modified examples without departing from the gist of the present invention or the scope of the appended claims.

10 Unrecrystallized grain

11 γ' grain (fine precipitate including γ' phase)

20 Recrystallized grain

21 η phase or δ phase

The invention claimed is:

1. A seal member made of a γ' precipitation-hardening alloy, wherein the γ' precipitation-hardening alloy has a component composition consisting of, in mass %:

Ni: from 40 to 62%;

Cr: from 13 to 20%;

Ti: from 1.5 to 2.8%;

Al: from 1.0 to 2.0% provided that Ti/Al: 2.0 or less;

Nb: 2.0% or less;

Ta: 2.0% or less provided that Nb+Ta: from 0.2 to 2.0%;

B: from 0.001 to 0.010%;

W: 3.0% or less; and

Mo: 2.0% or less provided that Mo+(½)W: from 1.0 to 2.5%, and optionally,

C: 0.08% or less;

Si: 1.0% or less;

Mn: 1.0% or less;

P: 0.02% or less;

S: 0.01% or less;

Co: 5% or less; and

Cu: from 0.1% to 3.0%, with the balance being Fe and inevitable impurities, and wherein the seal member has a hardness of 250 Hv or more, and has a cold-rolled microstructure where precipitates comprising a γ' phase are dispersed in a crystal grain, and wherein the cold-rolled microstructure maintains an area ratio of an unrecrystallized grain comprising the γ' phase in a crystal grain at 20% or more in an observation cross-section after heating at 900° C. for 400 hours.

2. The seal member according to claim 1, wherein the cold-rolled microstructure comprises 0.05% or more of an inhomogeneous strain.

3. The seal member according to claim 1, wherein the cold-rolled microstructure maintains an area ratio of an unrecrystallized grain comprising the γ' phase in a crystal grain at 30% or more in an observation cross-section after heating at 900° C. for 400 hours.

4. The seal member according to claim 1, wherein the seal member has a thickness in the range of from 0.05 mm to 0.5 mm.

5. The seal member according to claim 1, wherein the cold-rolled microstructure includes an inhomogeneous strain in the range of from 0.05% to 0.33%.

6. The seal member according to claim 1, wherein the seal member exhibits a high-temperature hardness in the range of from 170 Hv to 230 Hv at 900° C.

7. The seal member according to claim 1, wherein the cold-rolled microstructure is obtained without heat treatment after cold rolling, maintaining the cold-rolled microstructure in the seal member as used.

* * * * *